US005323541A

United States Patent [19]

Burnham

[11] Patent Number: 5,323,541

[45] Date of Patent: Jun. 28, 1994

[54] TEMPLATE FOR LAYING OUT A ONE-PIECE COVER FOR A STAIR STEP

[76] Inventor: Dwayne L. Burnham, 743 Ivy, Eugene, Oreg. 97404

[21] Appl. No.: 21,977

[22] Filed: Feb. 24, 1993

[51] Int. Cl.[5] ..... B43L 7/10

[52] U.S. Cl. ..... 33/562; 33/16; 33/415; 33/478

[58] Field of Search ..... 33/562, 563, 565, 566, 33/1 G, 411, 415, 418, 419, 452, 464, 465, 472, 473, 478, 526, 527

[56] References Cited

U.S. PATENT DOCUMENTS

| | | | |
|---|---|---|---|
| 1,563,229 | 11/1925 | Sanders . | |
| 1,624,535 | 4/1927 | Christianson . | |
| 2,536,359 | 1/1951 | Eliason . | |
| 2,879,556 | 3/1959 | Lyons | 33/562 |
| 3,015,164 | 1/1962 | Antell | 33/562 |
| 3,242,580 | 3/1966 | Crawford | 33/562 |
| 3,871,103 | 3/1975 | Simmons . | |
| 4,580,352 | 4/1986 | Wilson | 33/563 |
| 4,866,853 | 9/1989 | Braden | 33/465 |

*Primary Examiner*—William A. Cuchlinski, Jr.
*Assistant Examiner*—C. W. Fulton
*Attorney, Agent, or Firm*—Eugene M. Eckelman

[57] ABSTRACT

First and second longitudinal body portions are hinged longitudinally together and include adjustable end extensions which adjust the width of the body portion to the width of the stair tread surface and also the riser surface, whereby to form a cutting pattern for cutting out a one-piece tread and riser portion of a stair cover when the template is laid on the cover. The template also has a front depending lip on the first longitudinal body portion for engaging a lip on the cover when forming a marking and cutting pattern for the cover.

10 Claims, 1 Drawing Sheet

TEMPLATE FOR LAYING OUT A ONE-PIECE COVER FOR A STAIR STEP

BACKGROUND OF THE INVENTION

This invention relates to a template for laying out a stair step cover of the type that has the tread and riser portions combined in a one-piece unit.

A stair step cover now in common use, made of a tough plastic or rubber composition, is furnished in one-piece blanks that have a front lip and are dimensioned for simultaneously covering the tread surface of a step as well as its rear riser portion. Such blanks are of predetermined dimension from front to rear for fitting on existing steps that are also of selected dimension. These blanks however must be cut to width since there may be width and angular variables of the sides of the steps. Such fitting is very difficult in view of these variables and also in view of the close tolerances required by building specifications of architects.

Devices have heretofore been employed that form a gauge for constructing stair treads and risers. One such device for example is shown in U.S. Pat. No. 3,871,103. Devices for a similar purpose are also shown in U.S. Pat. Nos. 1,563,229, 1,624,535, 2,536,359 and 3,242,580. The devices of these patents have adjustment means for determining the width and end angles required for stair steps. They are not, however, designed for fitting a one-piece stair cover on an existing stairway and could not function as a template for marking out and cutting such cover, particularly a cover that is supplied in blank form for shaping to the width and contour of both the tread and riser portions of the step.

SUMMARY OF THE INVENTION

It is therefore an object of the invention to provide a template of improved structure that makes it capable of accurately shaping a step cover of the type formed in one piece for covering both the tread and riser portions of a step.

Other objects of the invention are to provide a device of the type described that is simple and inexpensive to manufacture and easy to use.

In carrying out the objects of the invention, the template comprises a pair of longitudinal body portions hinged together longitudinally. These two body portions have adjustment means on the ends thereof for adjusting for both the width of the step and the angular disposition of the side defining portions thereof. Upon setting of the adjustment means of the two body portions, the template is laid on a one-piece cover for marking out the cover. The template also comprises a front depending lip on one of the first longitudinal body portions for engaging the lip on the cover when forming a marking pattern for the cover.

The invention will be better understood and additional objects and advantages will become apparent from the following description taken in connection with the accompanying drawings.

DETAILED DESCRIPTION OF A PREFERRED EMBODIMENT

Figure 1:
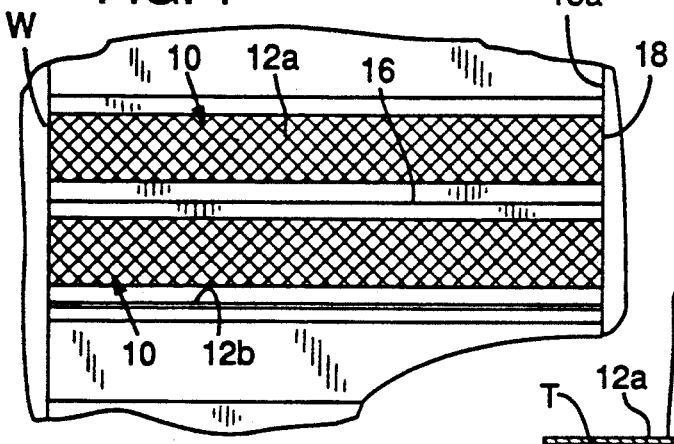
FIG. 1 is a fragmentary, top plan view of a stairway partially covered with a step covering of the type to be laid out and marked by the present template.

The present template is designed for forming a pattern to mark and/or cut stair covering made up of one-piece cover members 10. The tread portion of a step is designated by the reference character T and its riser portion by the reference character R, FIG. 2. Stair steps are conventionally constructed between side defining walls W, FIGS. 1 and 3, and such covers as stated above must fit precisely as to width and angular disposition of the side defining walls. Although the front to rear dimensions of the cover members are of common size to fit common size steps, the tread and riser portions are not precut to width in view of the variable requirements for stair step width and possible off-square portions of the side defining walls W. Such stair covers are rubber or plastic and have a tread portion 12*a*, FIGS. 1 and 2, and an integral riser portion 12*b*. The cover has a depending lip 14 across its front. The tread portion 12*a* and riser portion 12*b* are connected by a flexible joint 16 arranged to be contoured across the inside corner of the stairs.

The template of the invention comprises a first elongated body portion 20, FIGS. 2-5, having a downturned lip or flanged front end 22 arranged to fit over the front edge of a stair step. A second elongated body portion 24 is hingedly connected to the first body portion by a double hinge 26. This double hinge has two body members 26*a* and 26*b* secured to respective portions 20 and 24, and also has a central connector plate 26*c* hinged edgewise longitudinally to the hinge members 26*a* and 26*b*.

The body portions 20 and 24 of the template have adjustable extensions 28 and 30, respectively, on each end. These end extensions have adjustable stair width support on the respective body portions by attaching plates 32 with thumb screw and slot support connections 34, 35 between these plates and the end extensions. The body portion 20, being of greater dimension from front to rear than body portion 24, has two of the attaching plates 32. These plates, upon loosening the thumb screws 34, allow adjustable movement of the extensions 28 and 30 both in the width dimension of the template and also angularly with relation thereto. Extensions 28 have hinged flap edges 36 with finger tabs 38 thereon.

Figure 2:
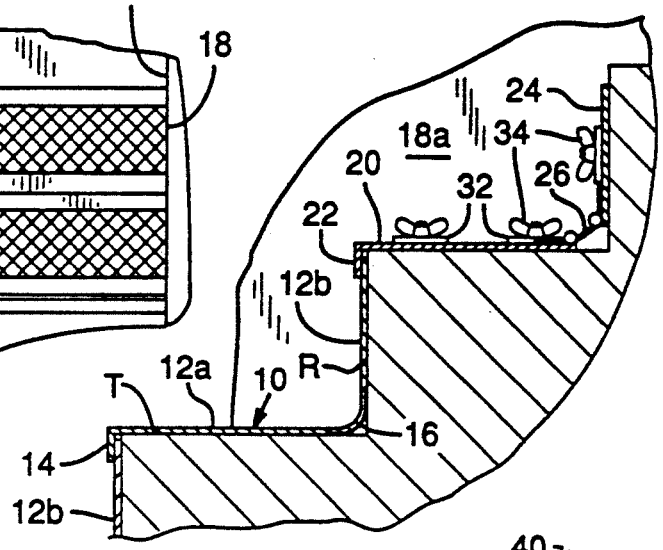
FIG. 2 is a sectional view taken through a stairway and showing an installed portion of a cover on a step thereof and the template of the invention laid on a next above step, this view being taken on the line 2—2 of FIG. 3.
Figure 3:
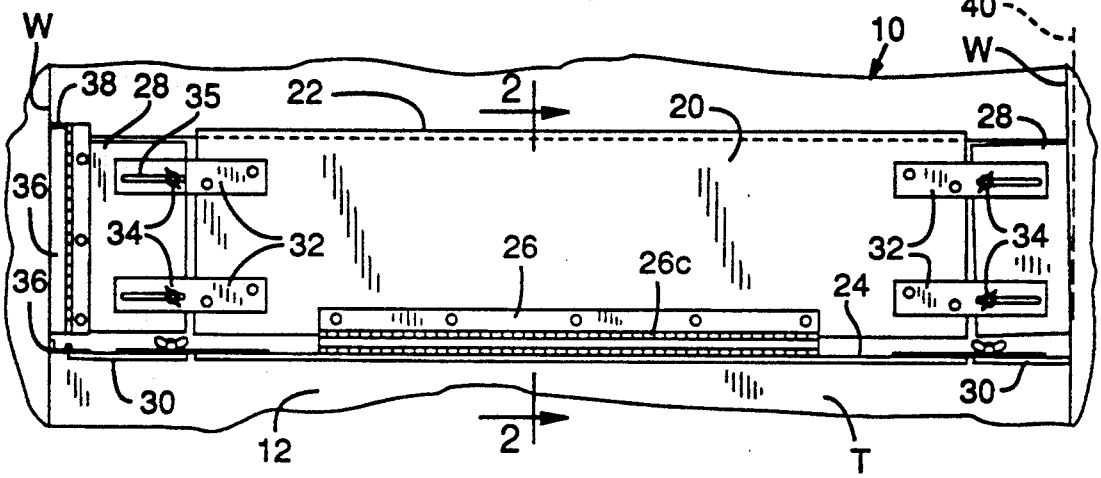
FIG. 3 is a top plan view of the present template as laid on a step as in FIG. 2.
Figure 4:
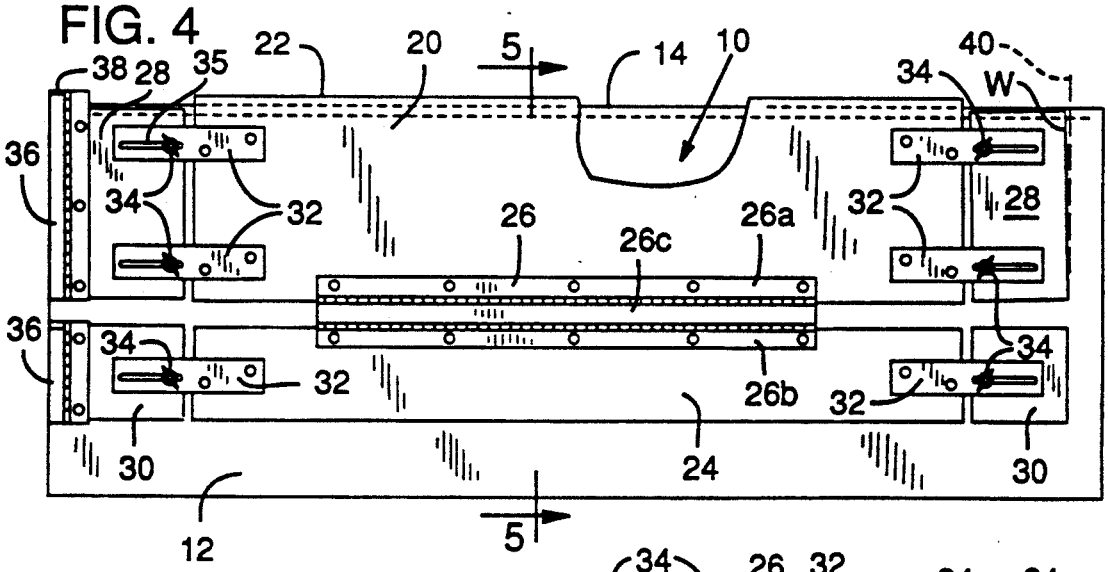
FIG. 4 is a top plan view of the template in its adjusted form laid on a step cover blank for marking the cover.

In the use of the present template, the end extensions 28 and 30 are first retracted to clear the defining walls of the stairway. The template is then laid on the bare stairway with the lip 22 thereof abutted against the stair edge. In FIG. 2, a lower step has already been covered and the template lip 22 for forwarding the template to shape the cover of the next step abuts against the upper riser end of the already laid cover. The device is laid such that the body portion 20 is supported on the stair tread T with the body portion 24 extending up along the riser R. The end extensions are then adjusted outwardly by means of the connections 34, 35, the hinged ends 36 being laid down flat during this procedure. The hinged ends 36 at this one end and the end extensions 28, 30 at the other end will by such adjustment abut against the defining side walls of the stairs. In this outward adjustment of the end extensions, they will abut against the side defining walls W of the stairs, thus assuming any off square direction of the walls. This feature is illustrated in FIGS. 3 and 4 wherein the square line of the walls is designated by the reference numeral 40 and wherein the end extensions 28, 30 have been adjusted to the unsquare line of wall W.

When all the extensions are firmly abutted against the side walls of the stairs, the connections 34, 35 are tightened and the template removed. To remove it, the hinged ends 36 are first turned up for providing sufficient clearance from the side walls.

Figure 5:
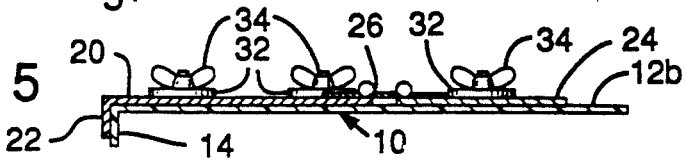
FIG. 5 is a cross sectional view taken on the line 5—5 of FIG. 4.

Thereupon the template is laid on a blank of the stair covering with the lip 22 of the template in engagement with the lip 14 of the cover, as seen in FIG. 5, whereby the step cover, when cut to the pattern made by the template, will fit substantially precisely between the defining walls of the stairway. The double hinge 26 provides the contour of the step cover at the flexible joint 16 of the latter. The template is thus simple to use and will enable relatively unskilled workmen to accurately install this type of stair covering.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A template for laying out a one-piece cover for a stair step having side defining means, the cover being of the type having a tread portion and an integral rear riser portion, said template comprising:

a first longitudinal body portion, a second longitudinal body portion, hinge means connected longitudinally between said first and second body portions for supporting said second body portion angularly upwardly in face relation to the riser portion of a step upon seated engagement of said first body portion on the tread portion of a step, and adjustment means on said first and second body portions for adjusting the width of said body portions to the width of the stair tread surface and riser surface whereby to form a marking pattern for cutting out a one-piece tread and riser portion of a stair cover when said template is laid on the cover.

2. The template of claim wherein said adjustment means on said first and second body portions are independently adjustable.

3. The template of claim 1 wherein said adjustment means is also adjustable angularly whereby to adjust the body portions to both the width of the tread and riser portion of the step between the side defining means and to the angular relation of the side defining means of the step.

4. The template of claim 3 wherein said adjustment means on said first and second body portions are independently adjustable.

5. The template of claim 1 wherein said hinge includes a pair of longitudinal body members, means securing said body members to respective first and second template body portions, and a longitudinal connector plate hingedly connected between said body members whereby to allow said first and second body members to extend angularly with relation to each other when supported on a step and to be contoured in the area between the tread and riser portions of a step.

6. A template for laying out a one-piece cover for a stair step having side defining means, the cover being of the type having a tread portion with a depending front lip and an integral rear riser portion, said template comprising:

a first longitudinal body portion having a front depending lip, a second longitudinal body portion, hinge means connected longitudinally between said first and second body portions for supporting said second body portion angularly upwardly in face relation to the riser portion of a step upon seated engagement of said first body portion on the tread portion of a step, and adjustment means on said first and second body portions for adjusting the width of said body portions to the width of the stair tread surface and riser surface, whereby to form a cutting pattern for cutting out a one-piece tread and riser portion of a stair cover when said template is laid on the cover with the depending lip of said first body portion engaged against the front lip of the cover.

7. The template of claim 6 wherein said adjustment means on said first and second body portions are independently adjustable.

8. The template of claim 6 wherein said adjustment means is also adjustable angularly whereby to adjust the body portions to both the width of the tread and riser portions of the step between the side defining means and to the angular relation of the side defining means of the step.

9. The template of claim 8 wherein said adjustment means on said first and second body portions are independently adjustable.

10. The template of claim 6 wherein said hinge includes a pair of longitudinal body members, means securing said body members to respective first and second template body portions, and a longitudinal connector plate hingedly connected between said body members whereby to allow said first and second body portions to extend angularly with relation to each other when supported on a step and to be contoured in the area between the tread and riser portions of a step.

* * * * *